US006634066B2

(12) United States Patent
Okada et al.

(10) Patent No.: US 6,634,066 B2
(45) Date of Patent: Oct. 21, 2003

(54) UPPER STOPPER DEVICE FOR SLIDE FASTENER

(75) Inventors: Yozo Okada, Toyama-ken (JP); Futoshi Kozato, Toyama-ken (JP); Yusuke Meiwa, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 10/082,263

(22) Filed: Feb. 26, 2002

(65) Prior Publication Data

US 2002/0116798 A1 Aug. 29, 2002

(30) Foreign Application Priority Data

Feb. 28, 2001 (JP) ..... 2001-054351

(51) Int. Cl.[7] ..... A44B 19/36

(52) U.S. Cl. ..... 24/433; 24/381; 24/390; 24/416; 24/436

(58) Field of Search ..... 24/433, 436, 390, 24/381, 416, 403

(56) References Cited

U.S. PATENT DOCUMENTS 1,918,779 A * 7/1933 Prentice ..... 24/433
1,952,506 A * 3/1934 Legat ..... 24/436
2,622,294 A * 12/1952 Legat ..... 24/433
2,988,796 A * 6/1961 Johns ..... 24/381
3,862,474 A * 1/1975 Ebata ..... 24/433
3,951,715 A * 4/1976 Hofius ..... 24/433
4,109,349 A * 8/1978 Tanaka ..... 24/433
4,223,425 A * 9/1980 Akashi ..... 24/436
4,752,992 A * 6/1988 Kondo et al. ..... 24/436
4,878,275 A * 11/1989 Kazui et al. ..... 24/436
5,359,754 A * 11/1994 Kondo et al. ..... 24/436

* cited by examiner

*Primary Examiner*—Victor Sakran
(74) *Attorney, Agent, or Firm*—Finnegan, Henderson, Farabow, Garrett & Dunner, L.L.P.

(57) ABSTRACT

In a upper stopper device for a slide fastener having a cross section of a substantially U shape, which is adapted to be attached continuously to a fastener element row of a stringer capable of being engaged with or separated from each other, an end portion of the upper stopper device opposite to the fastener element row is formed with a widened portion, which abuts against wing plates at a shoulder opening of a slider into which the stringer is inserted so that the slider can stop. Further, a caulking portion is formed in a range between the widened portion and at an end portion side toward the fastener element row. The slider abuts against the widened portion of the upper stopper device attached to the stringer so that it reliably stops.

12 Claims, 8 Drawing Sheets

UPPER STOPPER DEVICE FOR SLIDE FASTENER

BACKGROUND OF THE INVENTION

1. Field of the Invention

The present invention relates to an upper stopper device in order to prevent a slider, which is to be attached to an end of a fastener stringer, from escaping. Particularly, the present invention relates to an upper stopper device, which is suitable for a fastener stringer attached with a bottom end stop assembly.

2. Description of the Related Art

In a conventional upper stopper device of this kind, as shown in FIG. 8, upper stoppers of a fastener chain, which is attached with a bottom end stop assembly, is molded of thermoplastic resin material. In these upper stoppers 30, which are for example disclosed in Japanese Utility Model Publication No. 63-37844, both of top and bottom surfaces thereof are formed to be flat. Further, the upper stoppers 30 are formed integrally with projections 31, 31 capable of contacting and engaging with chamfered inclined planes 118 formed on an interior face of upper and lower wing plates 116, 116 at a shoulder opening side of a slider 107. When the slider 107 is slid in a closing direction thereof on a fastener chain 101, the projections 31, 31 of the upper stoppers 30 come to contact with the chamfered inclined planes 118 provided at the interior of the shoulder side end of the slider 107 so that they stop sliding of the slider 107.

Further, an upper stopper device of another type is for example disclosed in Japanese Utility Model Publication No. 63-1855 as shown in FIG. 9. Its upper stopper 40 is formed of a wire having a varied cross section and has a pair of upper and lower leg portions 42, 42 opened in a fork shape about a base portion 40 thereof so that a hollow portion 43 is formed between the upper and lower leg portions 42, 42. Further, a V-shaped groove 44 is formed at an inner face of the base portion for accommodating a tape elevated edge, which is not shown. The upper stopper clips a tape and then caulked by a punch.

The upper stoppers 30 shown in FIG. 8 are made of thermoplastic resin material and the projections 31, 31 are provided in such a way that they protrude locally on the flat surfaces of the upper stoppers. As a result, the upper stoppers are unpleasant to the touch. Additionally, when an external force such as excessive bending, twisting or the like is applied to the fastener chain so that the fastener tape 108 is bent from a border between an upper end of the upper stopper 30 and the fastener tape 108, thread tend to be cut off at a portion of the fastener tape 108 contacting with the upper end of the upper stopper 30.

Further, the upper stopper shown in FIG. 9 is formed of a wire having a varied cross section. When the upper stoppers 40 are attached to a stringer tape, which is not shown, the right and left upper stoppers 40, 40, which are entirely pressed and caulked, are capable of being inserted in a slider body, which is not shown. In the case that right and left stringers are fixed with a lower stopper device, it is possible to stop the sliding of the slider by a sliding contact of tape-side side faces of the right and left upper stoppers with an inner face of the slider. In the case that the slide fastener is a separable product with a bottom stop assembly, on the other hand, the upper stoppers 30 mounted to upper end portions of right and left stringers, which are not shown and attached with a box and a box pin, which are not shown either, separately at lower ends thereof, are easy to be inserted in the slider. Therefore, the slider tends to escape from the stringers so that it is lost. Further, an infant tends to put the escaped slider into his or her mouth.

SUMMARY OF THE INVENTION

The present invention has been made taking the foregoing problems into consideration. An object of the present invention relates to an upper stopper device of a slide fastener. Particularly, the object is to provide an upper stopper device which is most suitable for a fastener chain of a separable product attached with a bottom end stop assembly, as well as a fastener chain of a closed product which is fixed with a lower stopper device, and to provide an upper stopper device for a slide fastener as a safe separable product and the like that does not damage a fastener tape even if the fastener chain is applied with various external forces and has an excellent stop function of a slider. Particularly, there is no risk that an infant puts the upper stopper device into his or her mouth because the slider never escapes from the fastener chain of the separable product.

In addition to the object, another object of the present invention is to provide an upper stopper device for a slide fastener of a separable product and the like, which can be produced by a process with a good productivity. The upper stopper device is capable of being easily attached to fastener tapes, has a very simple mechanism to stop a slider and is capable of being accurately positioned and quickly attached by an automation machine for attaching the upper stopper device so that the productivity can be enhanced.

In addition to the object, another object of the present invention is to provide an upper stopper device for a slide fastener which is a safe product capable of preventing a slider from escaping from a stringer accurately. Further, another object is to provide an upper stopper device for a slide fastener which can exert an efficient stop function of the upper stopper device.

According to the present invention, there is mainly provided an upper stopper device for a slide fastener attached to an upper end of at least one of fastener element rows so as to be contiguous thereto, of fastener stringers capable of being engaged with and separated from each other, wherein the upper stopper device is formed with a widened portion, which protrudes from a front surface of the upper stopper device and is capable of abutting against at least one of upper and lower wing plates of a slider at a shoulder opening thereof, at an end portion of the upper stopper device on a side away from the fastener element rows.

According to such feature of the present invention, a slider inserted through a fastener chain never escapes. Further, the upper stopper device does not damage a fastener tape even when the fastener chain is applied with external forces such as excessive bending, twisting or the like so that the fastener tape is bent at a border between the upper stopper device and the fastener tape. Particularly, the upper stopper is suitable for a fastener chain attached with a bottom end stop assembly and it is possible to obtain an upper stopper device with a high quality and an excellent functionality.

According to the present invention, it is preferable that the upper stopper device is made of metal with a cross section of substantially U shape. In this case, it is preferable that the upper stopper device is provided with a caulking portion extending in a range from the widened portion to an end portion thereof adjacent to the fastener element rows. When metal material is used for the upper stopper device, the upper stopper device, which is free from a slider escaping, can be easily attached to the fastener tape by caulking the caulking portion firmly.

Further, the upper stopper device of the present invention has a base portion and an upper piece and a lower piece protruding from the base portion in a fork shape. Preferably, at least one of the upper and lower pieces has a widened portion which opens in parallel to a surface of the upper stopper device. Alternatively, at least one of the upper and lower pieces may have a widened portion which gradually opens in a protruding direction of at least one of the upper and lower pieces. Further alternatively, at least one of the upper and lower pieces may have a widened portion which gradually opens toward an end portion thereof away from the fastener element row. It is possible to easily mold the widened portions of such shapes, with which it is possible to exert a stop function of the slider.

Particularly, it is desirable that the upper stopper device is attached to at least an upper end of the fastener element row provided with a box and a box pin at a lower end thereof. Alternatively, the upper stopper device may be further attached to the fastener element row provided with an insert pin at a lower end thereof. Therefore, according to the present invention, it is possible to attach the upper stopper to a fastener chain with a bottom end stop assembly, and further it is possible to easily produce a product which prevents a slider from escaping, even though it is a conventional fastener chain with a bottom end stop assembly that was subject to an easy escaping of an upper stopper device.

Still further, it is desirable that the upper stopper 10 of the present invention is attached to an enlarged core portion provided along one side edge in a longitudinal direction of a fastener tape and a contact point P of the widened portion with each of the upper and lower wing plates of the slider is set to be toward the other side edge of the fastener tape with respect to a center line of a longitudinal direction of the core portion. With such a structure, it is possible to produce a fastener chain which provides an efficient stop function of a slider by the upper stopper device and provides the end portions with an inward property, and which is good in appearance.

DESCRIPTION OF EMBODIMENTS

Embodiments of an upper stopper for a slide fastener according to the present invention will be described in detail with reference to the drawings below.

It is a matter of course that the upper stopper for a slide fastener according to the present invention can be used a fastener chain 1 of a closed product. However, it is particularly suitable for a fastener chain 1 of a separable product, namely, the fastener chain 1 attached with a bottom end stop assembly which can be separated into a pair of fastener stringers 2 and 3.

Figure 1:
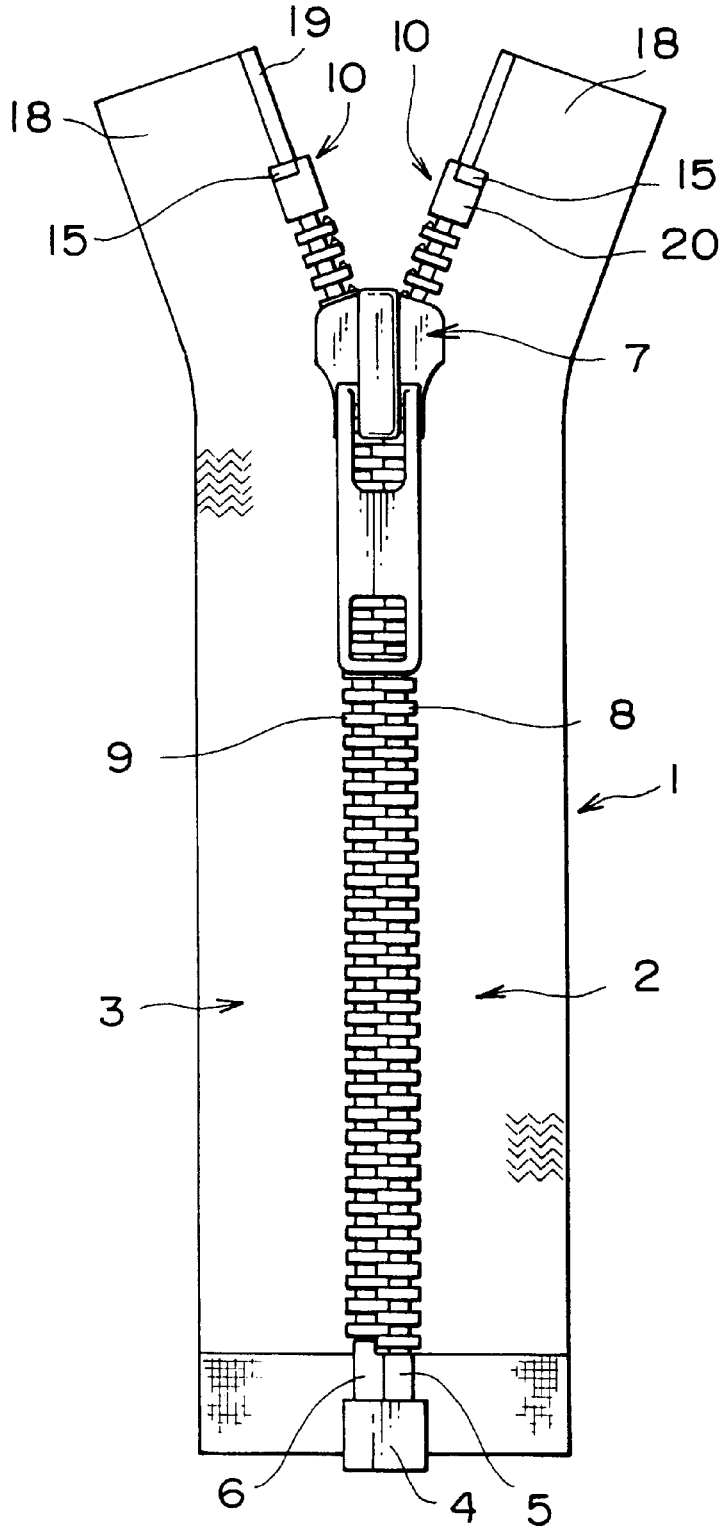
FIG. 1 is a front view of a slide fastener attached with a bottom end stop assembly.

As shown in FIG. 1, the fastener chain 1 is provided with an enlarged core portion 19 along one side edge in a longitudinal direction of a fastener tape 18, which is woven or knitted of synthetic fiber or natural fiber. At the core portion 19, each of fastener element rows 8 and 9, which is composed of a plurality of fastener elements E made of metal, is attached, so that fastener stringers 2 and 3 are formed. One fastener stringer 2 is provided with a box 4 and a box pin 5 at a lower end of the fastener element row 8. The other fastener stringer 3 is provided with an insert pin 6, which is capable of being inserted through a slider 7 and into the box 4, at a lower end of the fastener element row 9. The fastener element rows 8 and 9 are inserted through inside of the slider 7, which is slid along the fastener element rows 8 and 9, so that the fastener element rows 8 and 9 are coupled with and separated from each other. Further, upper stoppers 10 are attached to upper ends of the fastener element rows 8 and 9 for abutting against the slider 7 to stop its sliding movement.

In order to separate and release the closed fastener chain 1, the slider 7 is pulled down to the box 4 to abut therewith, so that the engagement of the fastener element rows 8 and 9 is released. Then, when the fastener stringer 3 at a side to which the insert pin 6 is attached is pulled, the insert pin 6 escapes from the box 4 and the slider 7. AS a result, the fastener chain 1 is separated into the fastener stringers 2 and 3, respectively. At this time, the slider 7 is left on the fastener stringer 2 at a side to which the box 4 is attached while the fastener element row 8 is inserted through the slider 7.

In most cases, the fastener chain 1 attached with a bottom end stop assembly is often attached at front bodies of a wear to be joined in use. Particularly, it is necessary to pay attention to the case that this fastener chain 1 is used in an infant's wear. In this case, when the joined portions of the wear are opened and an infant pulls up the slider 7 to the upper stopper 10 just for amusement, the slider 7 may escape from the fastener stringer 2 passing over the upper stopper 10, though it does not when the slider 7 remains in the vicinity of the box 4 of the fastener stringer 2. In this case, there is a danger that the infant may put the escaped slider 7 into his or her mouth. Therefore, an upper stopper device, whereby the slider 7 never escapes from the fastener stringer 2 at the side to which the box 4 is attached, has been invented.

Figure 2:
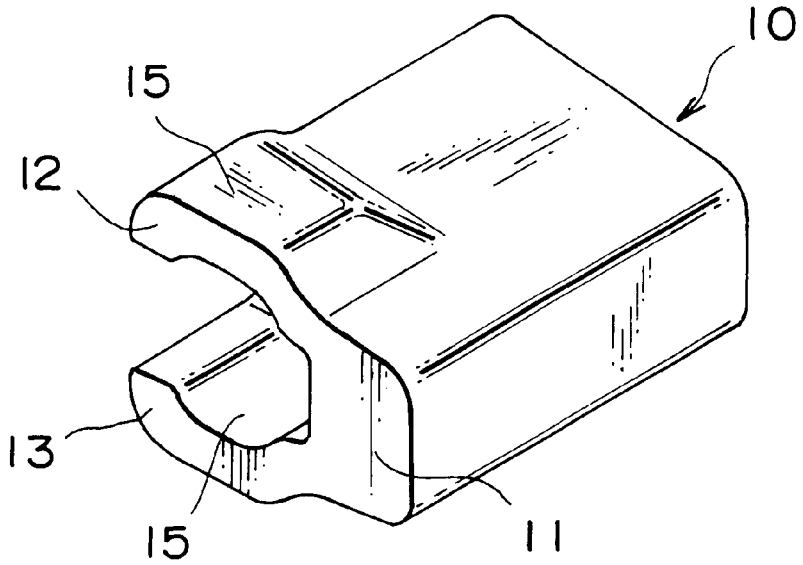
FIG. 2 is a perspective view of an upper stopper device according to a first embodiment of the present invention.
Figure 3:
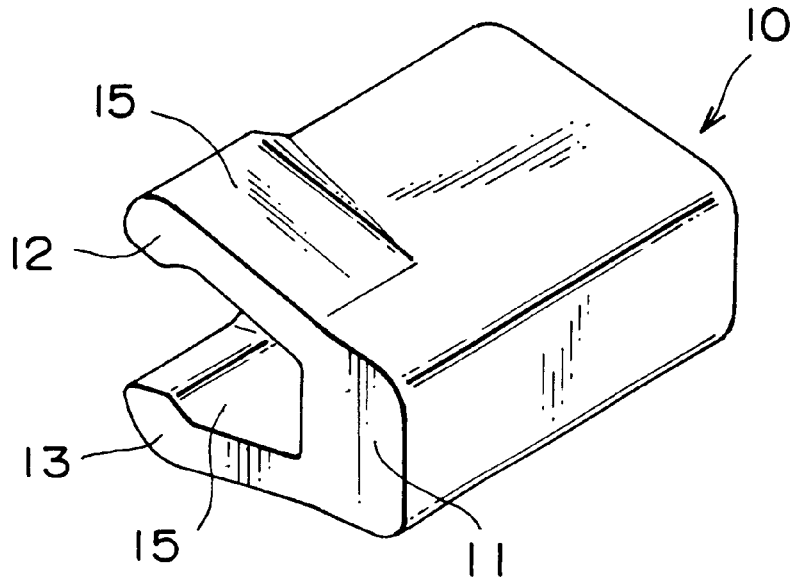
FIG. 3 is a perspective view of an upper stopper device according to a second embodiment of the invention.
Figure 4:
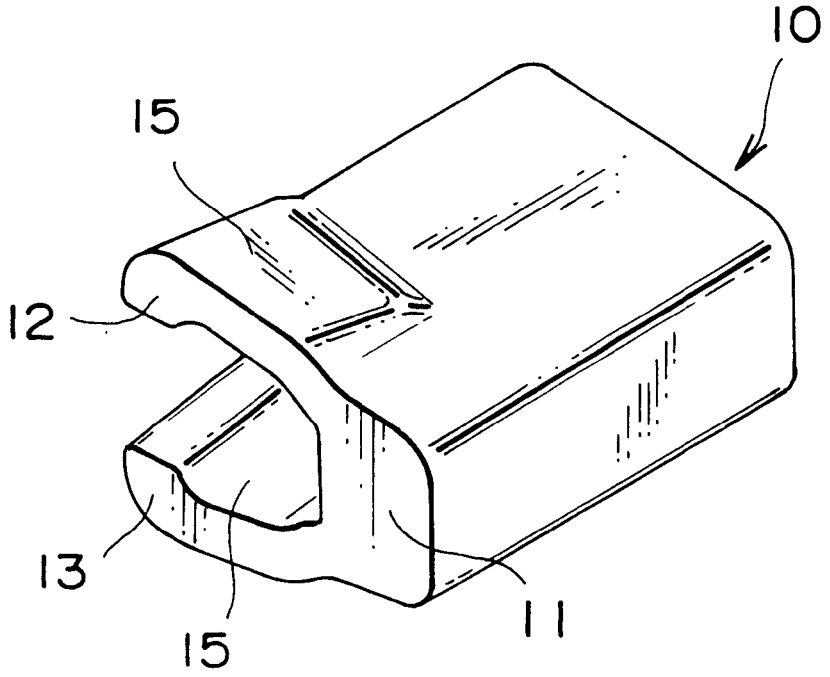
FIG. 4 is a perspective view of an upper stopper device according to a third embodiment of the present invention.
Figure 5:
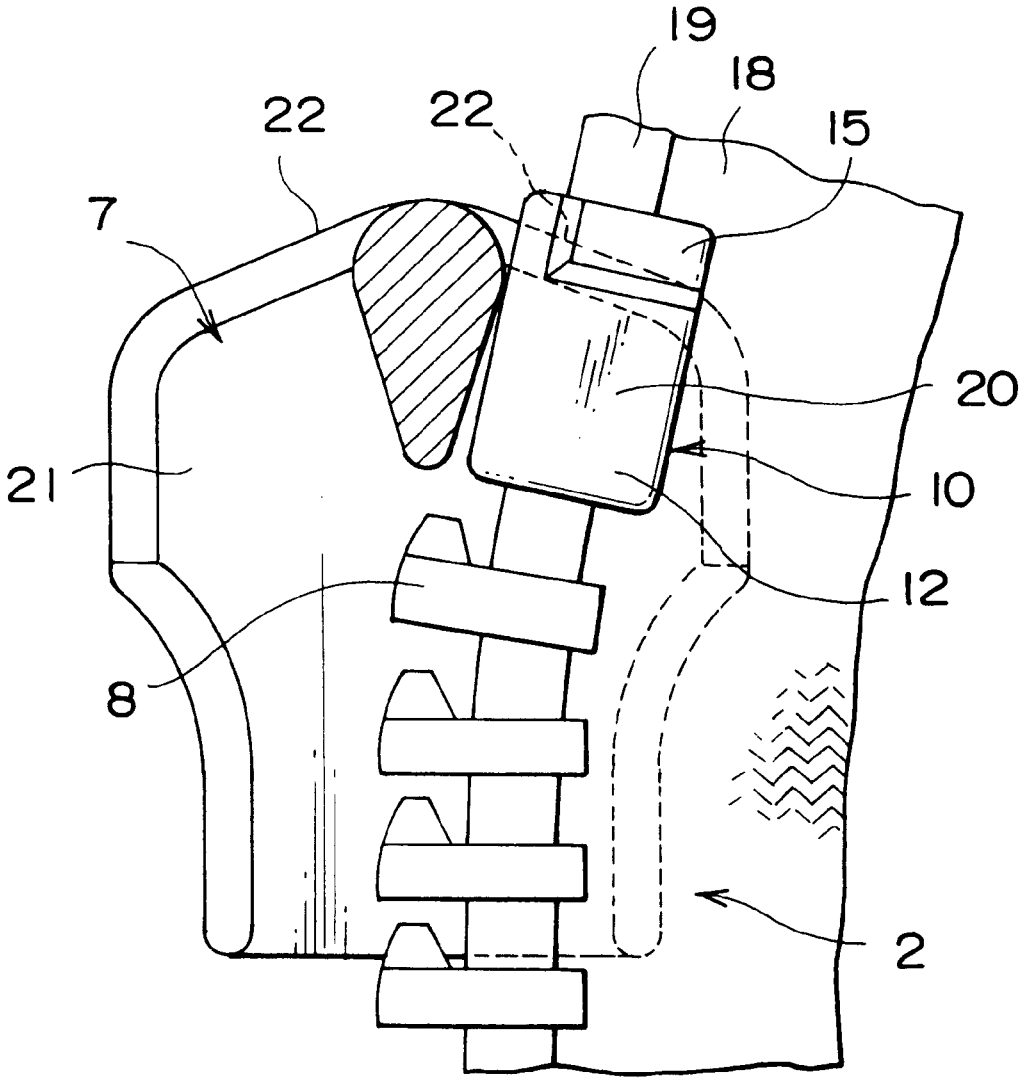
FIG. 5 is a partially cut front view for illustrating a state that a slider abuts the upper stopper of a stringer at a side of a box pin so that it stops.
Figure 6:
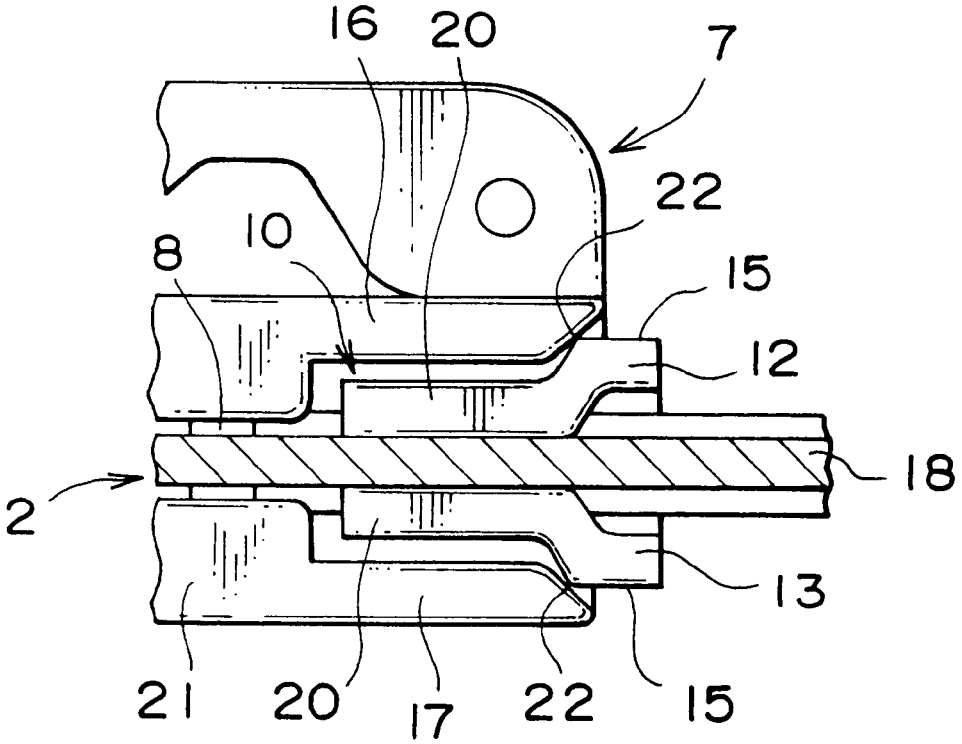
FIG. 6 is a partially cut side view for illustrating a state that the upper stopper device and the slider stop.

Therefore, the invented upper stopper device is shown in FIGS. 2, 3 and 4 as the upper stoppers 10. At first, upper stoppers 10 shown in FIG. 2 will be explained. The upper stopper 10 is manufactured by cutting a wire having a varied cross section into an upper stopper with a cross section of substantially U shape. At one end of the upper stopper 10, namely, at end portions of an upper piece 12 and a lower piece 13 at a side separated from the fastener element row 8 when the upper stopper 10 is attached to the stringer 2, a widened portion 15 protruded entirely in parallel is formed on a front surface of each upper stopper 10 such that a space between the upper piece 12 and the lower piece 13 is widened. As shown in FIGS. 5 and 6, this upper stopper 10 is fixed by caulking end portions of the upper piece 12 and the lower piece 13, which are adjacent to the fastener element row 8 excluding the widened portion 15, to the core portion 19 provided on one side edge in a longitudinal direction of the fastener tapes 18, so that a caulking portion 20 is formed. Then, upon sliding the slider 7, the widened portions 15 of the upper stoppers 10 abut against a shoulder opening 22 of upper and lower wing plates 16 and 17 of the slider 7, so that the slider 7 ever escapes from the fastener stringer 2.

Next, according to the upper stopper shown in FIG. 3, upon manufacturing the upper stopper 10 with a cross section of substantially U shape by cutting a wire having a varied cross section, one end of the upper stopper 10, namely, the upper piece 12 and the lower piece 13 at a side away from the fastener element row 8 when the upper stopper 10 is attached to the stringer 2, are formed with widened portions 15 protruding from front and rear surfaces of the upper stopper 10 while being entirely inclined so as to gradually enlarge a space between the upper piece 12 and the lower piece 13. When the end sides of the upper piece 12 and the lower piece 13 adjacent to the fastener element 8 except for the widened portions 15 are caulked and fixed to the core portion 19 of the fastener tape 18, the widened portions 15 abut against a shoulder opening 22 of the upper and lower wing plates 16 and 17 of the slider 7, so that the slider 7 is prevented from escaping from the fastener stringer 2.

According to the upper stopper shown in FIG. 4, upon manufacturing the upper stopper 10 with a cross section of substantially U shape by cutting a wire having a varied cross section, one end of the upper stopper 10, namely, the upper piece 12 and the lower piece 13 at a side away from the fastener element row 8 attached to the fastener tape 18, are formed with widened portions 15 protruding on the front surfaces by forming inclined faces gradually enlarging a space from the other ends thereof, namely, caulking portions 20 at a side adjoining the fastener element row 8 attached to the fastener tape 18 toward the one end side. When the upper stopper is fixed by caulking the portions except for the widened portions 15 to the core portion 19 of the fastener tape 18, the widened portions 15 of the upper stopper 10 abuts against the shoulder opening 22 of the upper and lower wing plates 16 and 17 of the slider 7, so that the slider 7 never escapes from the fastener stringer 2 attached with a box 4 and a box pin 5.

Figure 7:
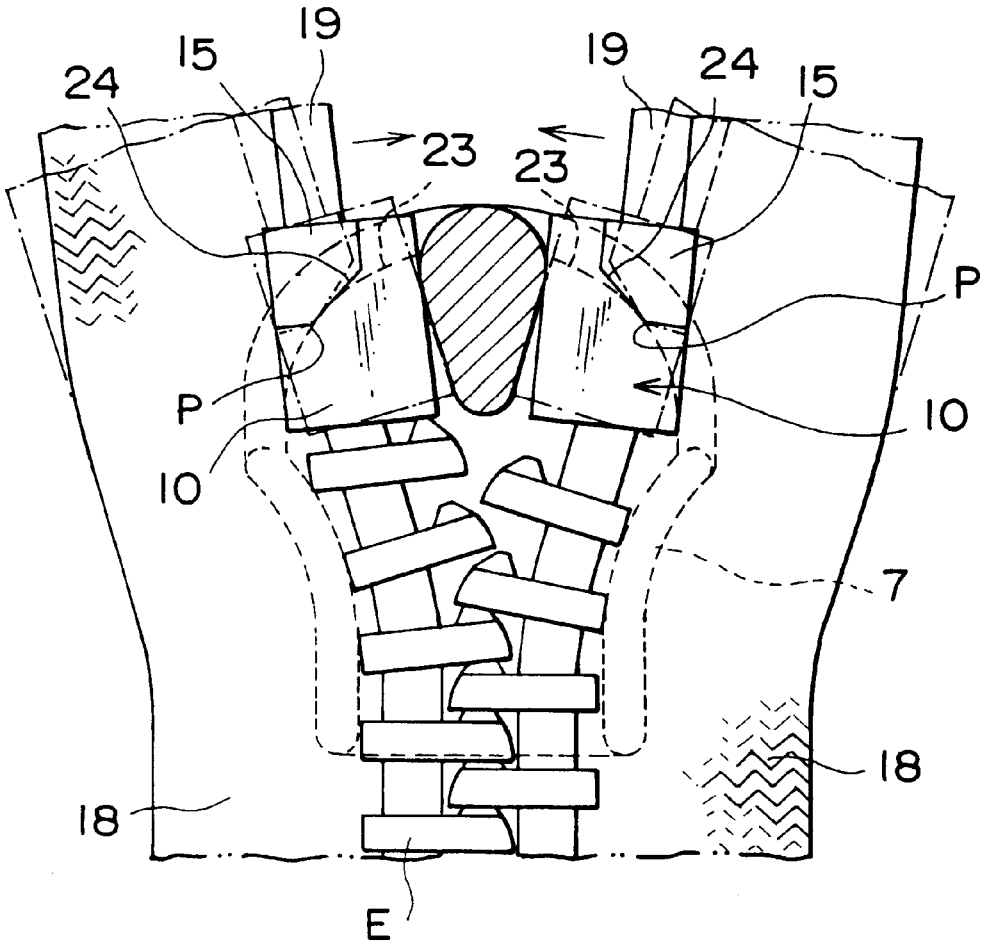
FIG. 7 is an operational view for illustrating a state that upper stoppers are disposed on right and left fastener stringers so that an inward property is provided to an end portion thereof by the upper stopper.
Figure 8:
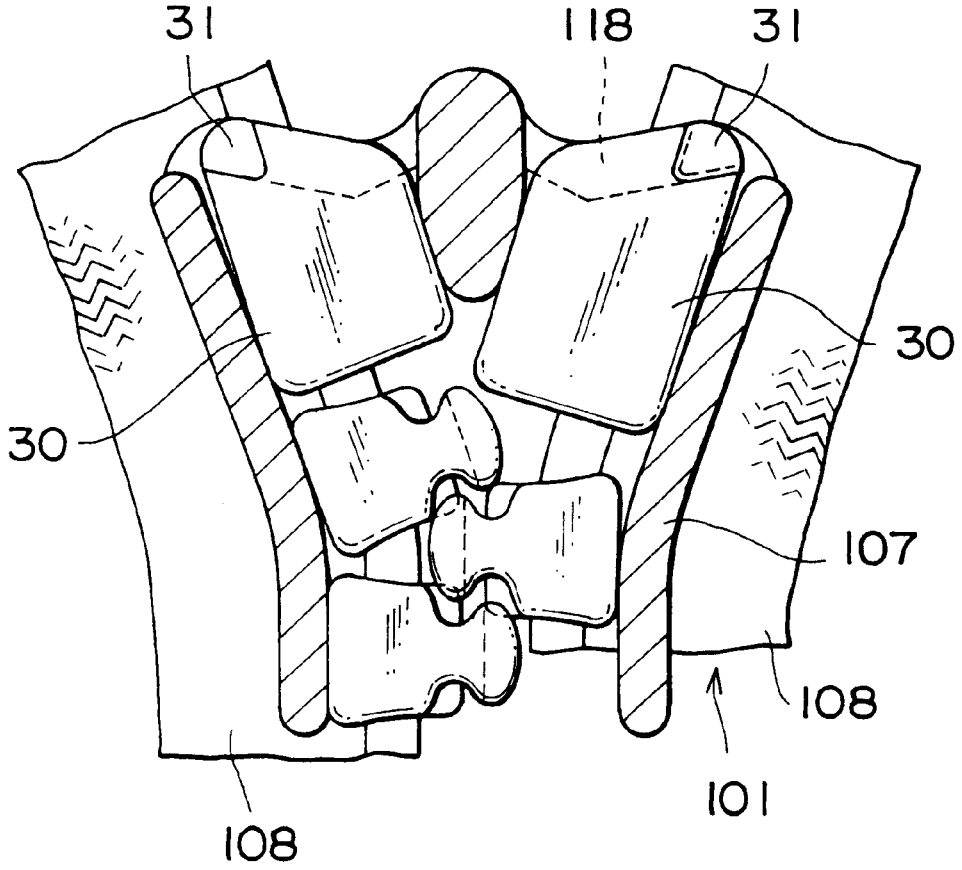
FIG. 8 PRIOR ART
FIG. 8 is a partially-cut front view for illustrating a state that a well known upper stopper made of thermoplastic resin and a well known slider stop.
Figure 9:
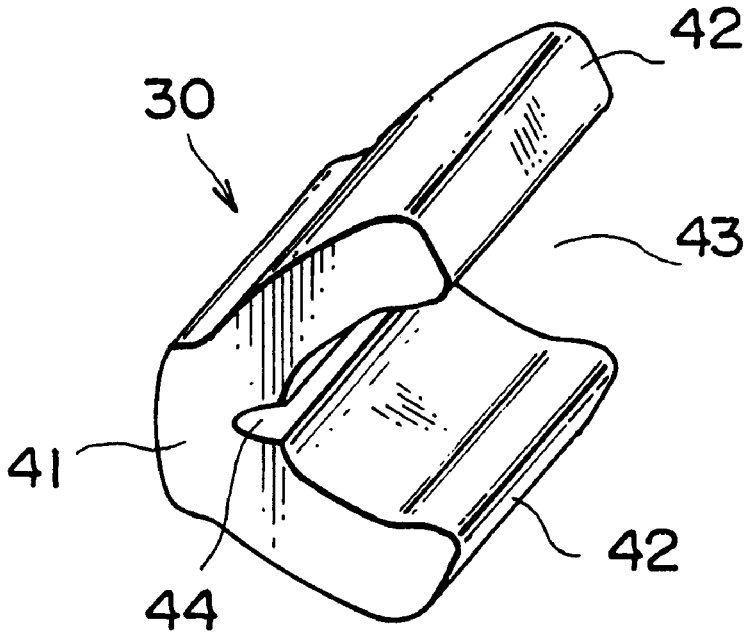
FIG. 9 PRIOR ART
FIG. 9 is a perspective view of the other well known upper stopper.

In the last place, according to the upper stopper shown in FIG. 7, upon manufacturing the upper stopper 10 with a cross section of substantially U shape by cutting a wire having a varied cross section, one end of the upper stopper 10, namely, the widened portions 15 formed on an upper piece 12 and a lower piece 13 at a side away from a fastener element row 8 attached to a fastener tape 18 are different in shape from the above-described embodiments, in which a face of the widened portion 15 abutting against a shoulder opening 22 of a slider 7 is formed into an inclined face 24, which is steeper than a curved face 23 of the shoulder opening 22 of the slider 7. Further, a contact point P at which the widened portion 15 abuts against the shoulder opening 22 of the slider 7 is disposed inward of the fastener tape 18 with respect to a center line of a core portion 19 disposed on one side edge of the fastener tape 18.

Since the contact point P of the widened portion 15 of the upper stopper 10 with the shoulder opening 22 of the slider 7 is deviated to the inside of the fastener tape 18 with respect to a center line of the core portion 19 disposed on the fastener tape 18, an inward force (as indicated by an arrow) is applied to the upper stopper 10. As a result, the end portion of the fastener chain 1 is closed, so that it is possible to realize a fastener chain 1 having a good appearance.

According to each of the above described embodiments, at the end portion of the upper stopper 10 the side away from the fastener element row 8, the upper piece 12 and the lower piece 13 of the upper stopper does not fix the core portion 19 of the fastener tape 18 by caulking, so that it is possible for the core portion 19 to move slightly between the upper piece 12 and the lower piece 13.

Thus, even if an external force such as excessive bending, twisting and the like is provided to the fastener chain 1 and the fastener tape 18 is bent at an end portion of the upper stopper 10 at a side away from the fastener element row 8, a starting point of the bending is separated from a border of the upper and lower pieces 12 and 13 of the caulking portion 20 for caulking and fixing the core portion 19 and the fastener tape 18, so that the upper and lower pieces 12 and 13 do not bite into the fastener tape 18 excessively and it is possible to prevent thread breakage of the fastener tape 18.

The upper stopper according to each of the above described embodiments can be obtained by cutting a wire having a varied cross section as its material. The wire having a varied cross section has a thick portion, which corresponds to the base portion 11, at one side edge thereof. Further, at upper end lower ends of the portion corresponding to the base portion 11, portions corresponding to the upper piece 12 and the lower piece 13, of which front end portions are slightly directed inward and formed to be thick, are formed to be integral with each other. By using metal such as zinc alloy, copper alloy, and aluminum alloy or the like for the wire having a varied cross section, it is possible to form a wire having a varied cross section of substantially U shape. Alternatively, the upper stopper may be molded of synthetic resin material and welded to be fixed in a state that the upper piece 12 and the lower piece 13 clip the fastener tape 18.

In a case of the separable product attached with a bottom end stop assembly, in which the fastener chain 1 is provided with a box 4, a box pin 5 and an insert pin 6 at lower ends of the fastener element rows 8 and 9, the upper stopper 10 may be attached to an upper end of the fastener element row 8 of the fastener stringer 2 provided with the box 4 and the box pin 5 at the lower end thereof.

Meanwhile, ranges of the widened portion 15 and the caulking portions 20 of the upper stopper 10 may be appropriately set considering an attaching strength of the upper stopper 10 to the fastener tape 18. Additionally, the widened portion 15 may be formed at least one of the upper piece 12 and the lower piece 13. Even if the widened portion 15 abuts against either one of the wing plate 16 or 17, it is possible to exert the stopping function to the same degree. Since the widened portion 15 has such a shape that is obtained by deforming a part of at least one of the upper piece 12 and the lower piece 13 in a direction widening a space between the upper piece 12 and the lower piece 13. Therefore, the upper stopper is good and pleasant to the touch, which was not achieved in a conventional one with local protrusions.

Reference Numerals

1 fastener chain
2,3 fastener stringer
4 box
5 box pin
6 insert pin
7 slider
8,9 fastener element row
10 upper stopper device
11 base portion

12 upper piece
13 lower piece
15 widened portion
16 upper wing plate
17 lower wing plate
18 fastener tape
19 core portion
20 caulking portion
P contact point

What is claimed is:

1. An upper stopper device for a slide fastener, which is adapted to be attached to an upper end of at least one of fastener element rows of fastener stringers capable of being engaged with or separated from each other, wherein said upper stopper device comprises upper and lower pieces, wherein each of said upper and lower pieces has an attaching portion provided at a side toward the fastener element row for being attached to said fastener stringer, and a widened portion provided at a side separated from the fastener element row and protruded on a front surface of said upper stopper device, wherein a space between said widened portions of said upper and lower pieces is so widened that each of said upper and lower pieces has a gap with respect to front and rear surfaces of said fastener stringer when said attaching portions are attached to the fastener stringer, and wherein part of at least one widened portion is capable of abutting against at least one wing plate at a shoulder opening of a slider.

2. An upper stopper device for a slide fastener according to claim 1, wherein said upper stopper device is made of metal having a cross section of a substantially U shape and said attaching portions are caulking portions.

3. An upper stopper device for a slide fastener according to claim 1, wherein said upper stopper device has a base portion, said upper piece and said lower piece protrude from said base portion in a fork shape, and said at least one widened portion opens in parallel to a front surface of said upper stopper device.

4. An upper stopper device for a slide fastener according to claim 1, wherein said upper stopper device has a base portion, said upper piece and said lower piece protrude from said base portion in a fork shape, and said at least one widened portion gradually widens in a protruding direction of one of said upper piece and said lower piece.

5. An upper stopper device for a slide fastener according to claim 1, wherein said upper stopper device has a base portion, said upper piece and said lower piece protrude from said base portion in a fork shape, and said at least one widened portion gradually widens toward an end portion side away from said fastener element row.

6. An upper stopper device for a slide fastener according to claim 1, where said upper stopper device is attached to an upper end of said fastener element row provided with a box and a box pin at a lower end thereof.

7. An upper stopper device for a slide fastener according to claim 6, wherein said upper stopper device is further attached to an upper end of said fastener element row provided with an insert pin at a lower end thereof.

8. An upper stopper device for a slide fastener according to claim 1, wherein said upper stopper device is attached to an enlarged core portion provided along one side edge in a longitudinal direction of a fastener tape and a contact point of said at least one widened portion with a wing plate and a wing plate of a slider is disposed toward the other side edge of said fastener tape with respect to a center line in a longitudinal direction of said core portion.

9. An upper stopper device for a slide fastener according to claim 1, wherein part of each widened portion is capable of abutting against each wing plate at a shoulder opening of a slider.

10. An upper stopper device for a slide fastener according to claim 9, wherein said upper stopper device has a base portion, said upper piece and said lower piece protrude from said base portion in a fork shape, and each widened portion opens in parallel to a front surface of said upper stopper device.

11. An upper stopper device for a slide fastener according to claim 9, wherein said upper stopper device has a base portion, said upper piece and said lower piece protrude from said base portion in a fork shape, and each widened portion gradually widens in a protruding direction of said upper piece and said lower piece.

12. An upper stopper device for a slide fastener according to claim 9, wherein said upper stopper device has a base portion, said upper piece and said lower piece protrude from said base portion in a fork shape, and each widened portion gradually widens toward an end portion side away from said fastener element row.

* * * * *